US007123202B2

(12) United States Patent
Maeuser et al.

(10) Patent No.: US 7,123,202 B2
(45) Date of Patent: Oct. 17, 2006

(54) ANTENNA WINDOW WITH HIGH-FREQUENCY COMPONENT

(75) Inventors: Helmut Maeuser, Herzogenrath (DE); Bernhard Reul, Herzogenrath (DE)

(73) Assignee: Saint-Gobain Glass France, Courbevoie (FR)

( * ) Notice: Subject to any disclaimer, the term of this patent is extended or adjusted under 35 U.S.C. 154(b) by 13 days.

(21) Appl. No.: 10/480,635

(22) PCT Filed: Jun. 19, 2002

(86) PCT No.: PCT/FR02/02110

§ 371 (c)(1),
(2), (4) Date: May 13, 2004

(87) PCT Pub. No.: WO03/009415

PCT Pub. Date: Jan. 30, 2003

(65) Prior Publication Data

US 2004/0178961 A1 Sep. 16, 2004

(30) Foreign Application Priority Data

Jun. 20, 2001 (DE) ..... 101 29 664

(51) Int. Cl.
*H01Q 1/32* (2006.01)
*H01Q 1/02* (2006.01)

(52) U.S. Cl. ..... 343/713; 343/704; 343/715; 343/745; 343/712; 343/860

(58) Field of Classification Search ..... 343/711–713, 343/704, 767, 769–770, 701, 850, 715, 745, 343/860; 174/149 R, 138 R
See application file for complete search history.

(56) References Cited

U.S. PATENT DOCUMENTS

| | | | | |
|---|---|---|---|---|
| 4,931,805 | A | 6/1990 | Fisher | 343/716 |
| 5,049,892 | A * | 9/1991 | Lindenmeier et al. | 343/713 |
| 5,289,197 | A * | 2/1994 | Lindenmeier et al. | 343/713 |
| 5,307,076 | A * | 4/1994 | Murakami et al. | 343/704 |
| 5,734,355 | A * | 3/1998 | Watanabe | 343/859 |
| 5,898,407 | A * | 4/1999 | Paulus et al. | 343/713 |
| 5,905,469 | A * | 5/1999 | Lindenmeier et al. | 343/713 |
| 6,025,806 | A * | 2/2000 | Deininger et al. | 343/713 |
| 6,164,984 | A | 12/2000 | Schreiner | 439/86 |
| 6,377,221 | B1 * | 4/2002 | Lindenmeier et al. | 343/713 |
| 6,534,720 | B1 * | 3/2003 | Von Alpen et al. | 174/149 R |

FOREIGN PATENT DOCUMENTS

| | | |
|---|---|---|
| DE | 196 27 052 | 1/1998 |
| DE | 198 58 299 | 6/2000 |
| EP | 0 961 342 | 12/1999 |
| EP | 1 009 060 | 6/2000 |

* cited by examiner

*Primary Examiner*—Tho Phan
*Assistant Examiner*—Chuc Tran
(74) *Attorney, Agent, or Firm*—Oblon, Spivak, McClelland, Maier & Neustadt, P.C.

(57) ABSTRACT

An antenna window with a high-frequency electric component placed fixedly on one of its surfaces, which is electrically connected to a conductor structure provided on the same surface of the window. The high-frequency component has at least one flat coupling electrode, which is kept at a specific distance from the flat conductor structure conducting high-frequency antenna signals, by an intermediate dielectric layer, to form the electrical connection.

10 Claims, 5 Drawing Sheets

ANTENNA WINDOW WITH HIGH-FREQUENCY COMPONENT

BACKGROUND OF THE INVENTION

1. Field of the Invention

The invention relates to an antenna window with a high-frequency component with the characteristics of the preamble of claim 1.

2. Discussion of the Background

Document DE-A1-198 23 202 describes an antenna device for a vehicle, in which the foot connections of all the antennas placed on a transparent (glass) window connected at contact points of a contact field are surrounded by a plastic mount placed on the surface of the window, and in which a high-frequency component, for example an amplifier, is removably fixed. In this case spring contacts are used for the electrical connections between the high-frequency component and the contact points. The latter are, of course, simple to mount and remove, but at the same time they are relatively sensitive to the corrosion and mechanical vibrations which occur.

Document DE-A1-198 56 663 discloses a device for bringing an antenna placed on a windowpane in contact with an amplifier housing fixed to the windowpane. The connection zone is surrounded by a layer of adhesive, while the electrical contacts are preferably produced by soldering. Document U.S. Pat. No. 6,087,996 shows a similar arrangement with spring contacts, in which the amplifier housing is removably fastened to the surface of the window by means of a velcro assembly.

It is known from DE-A1-197 35 395 to capacitively couple a flat conducting layer acting as an antenna on a transparent (glass) window to a connection conductor, through which the antenna signal is routed to the radio receiver. In this case, the capacitive coupling is accomplished by printing a strip-like electrode on the face of a laminated window turned toward the passenger compartment, while placing the conducting layer on a surface located within the composite. The length of the strip-like electrode must be more than 5 cm, and its width from 5 to 10 mm.

Document DE-A1-198 58 299 shows an antenna system for a data communication device in a vehicle: two sides of a dielectric mounting surface, such as a glazing unit, may be connected together by capacitively coupling the components of the antenna system placed on the flat coupling electrodes.

Documents U.S. Pat. No. 4,931,805 and U.S. Pat. No. 4,931,806 describe a telephone antenna placed on the window of a vehicle: an external module supports the antenna while an internal module is connected to this antenna by capacitive signal transmission. The glazing unit is used as a dielectric. The two modules are fastened to the surfaces of the glazing unit by double-sided adhesive tape.

SUMMARY OF THE INVENTION

The object of the invention, starting from a known window with a high-frequency component, is to provide another connection variant for the contacting process of the high-frequency component placed on the surface of the window.

According to the invention, this objective is obtained by an antenna window including a high-frequency electric component placed fixedly on surface of the antenna window, which is electrically connected by an electrical connection to a flat conductor structure provided on a same surface of the antenna window. The high-frequency electric component has at least one flat coupling electrode, which is kept at a specific distance from the flat conductor structure conducting high-frequency antenna signals, by an intermediate dielectric layer, to form the electrical connection, and the flat conductor structure, the intermediate dielectric layer, and the at least one flat coupling electrode act as a capacitor.

A multitude of antenna signals may also be transmitted by capacitive means in a high-frequency component, with negligible damping losses, even without specific contact points, by means of a flat electrode. To this end, it is necessary first of all to provide, on the window, a flat conductor structure to conduct the antenna signals. In this case, it may involve diversity antennae signals for radio and TV reception. This may also be more combined radio/TV and radiotelephony, GPS signals and the like. These signals may be filtered and employed separately in the high-frequency component by means of suitable components, and in particular amplified and restored later.

Naturally, the two coupling electrodes must completely overlap, since the capacitance is proportional to the surface area of the electrodes. An incomplete overlap leads to a reduction in the coupling capacitance and thus to an increase in the low-frequency damping. In general, said overlap will be ensured by the fact that the conductor structure used as a coupling point is spread over the surface of the window in the form of an associated coupling or surface electrode, such that small differences in position remain ineffective.

One great advantage of this arrangement is that the high-frequency component may be made in the form of a single plate having no galvanic contact with the window.

The intermediate dielectric layer may be a layer of air with a specific thickness, if it is possible to keep the latter permanently constant after fastening the high-frequency component to the antenna window.

This may-be achieved, for example, by means of suitable mounting devices with spacers. In general, the high-frequency component will be adhesively bonded to the surface of the window. When it has its own housing, only the external electrical connections still have to be made after the adhesive bonding. When the high-frequency component does not have its own housing, it may—naturally after thoroughly checking the operation—be permanently overmolded with a suitable compound. Thus the ambient effects are removed virtually hermetically, although the high-frequency component itself need not have its own sheath. This also contributes to decreasing the projection above the surface of the window. Specifically in the application case of the antenna window in a vehicle, reliable protection against moisture and water vapor is essential.

The width of the capacitive transmission zone may, in a preferred embodiment, be made by means of (double-sided) adhesive tape with a specific thickness, which firstly directly forms an intermediate dielectric layer between the conducting structure on the side of the window and the coupling electrode of the high-frequency component. Secondly, the fastening for the high-frequency component is in this way very considerably simplified. The adhesive tape material can permanently provide compliance with the desired width, or with the separation of the electrodes from the capacitive transmission zone.

Another advantage of this arrangement is the short signal path from the antenna to the high-frequency component, particularly when the latter comprises an amplifier. Thus, in this way, both the losses and the perturbative effects remain very small. The high-frequency component may also comprise, for example, one or more tuners and the like in addition to one or more amplifiers.

Likewise, the replacement of a component which may be defective is not particularly complicated. The overmolding compound may be removed, possibly at the same time as the component becomes unusable, and the adhesively bonded assembly may be removed, no particular operation being needed to detach the contacts, as with the spring contacts.

It goes without saying that the arrangement, described here, of a high-frequency component on an antenna window may be used both on glass windows and on plastic windows and naturally equally well on monolithic windows as on laminated windows.

The connection between the conducting structure and the antenna elements together with the manufacture and the type thereof will not be discussed further here, since numerous embodiments and combinations have been described before in the prior art.

It should however be stated that the transmission of signals from the conducting structure to the coupling electrode under the high-frequency component is not limited to a single zone or transmission capacitor. On the contrary, it is also possible to divide the (printed or adhesively bonded) conducting structure into several electrically separate parts, each one of which is connected to an antenna field or the like. In other words, several coupling points may thus be locally close on one window surface. The signals conducted by them are coupled in parallel in the high-frequency component overlapping this plurality of transmission capacitors by means of a corresponding number of coupling electrodes which are individually spatially and functionally combined.

Thus it is possible to bring together locally, for example at a point on a surface of the window, signals from the antenna structures, which are distributed over several windows (for example side and rear windows of motor vehicles), as may be provided for particularly in diversity antenna systems. However it is necessary to be attentive to the fact that, in such multiple solutions, contact distances which are too small (of parts of the conducting structure with respect to each other) may lead to crosstalk of the signals. To reduce or prevent this effect, the distance between two contact faces should be greater than the length of the contact edges separated from each other by this distance.

Other details and advantages of the object of the invention will become apparent from the drawing of an exemplary embodiment and by the following detailed description.

DESCRIPTION OF THE PREFERRED EMBODIMENTS

A transparent monolithic glass window 1 bears, close to the edge of one of its surfaces, both an opaque coating 2 and an electrically conducting structure 3 placed on the latter. The opaque coating and conducting structure are preferably produced in a known manner by screen printing using corresponding pastes, which may then be baked (on a glass window). The opaque coating 2 must not be electrically conducting. On the other hand, the conducting structure 3 is preferably produced in a known manner with a screen-printing paste with a high silver content, as is known by current busbars for printed and baked heater conductors or also for heating layers in motor vehicle windows. Ideally, the conducting structure 3 may also, in the present application case, have another function of being a busbar of this type. In a known manner, antenna structures may also be used as heating elements, when they are provided with a supply voltage from the on-board network.

A high-frequency component HF, to which we will return again further on, is newly fastened to the conducting structure 3 by means of thin double-sided adhesive tape 4.

Depending on the final client requirement, another visually opaque masking layer, which is not electrically conducting, could be located between the conducting structure 3 and the adhesive tape.

In the mounted state of the antenna window 1 in a vehicle bodywork (not shown), this device is generally located on a surface turned toward the interior space of the vehicle, and it is masked on the inside by an interior coating. The opaque coating 2 masks the conducting structure 3 and the high-frequency component HF visually from the outside.

Figure 1:
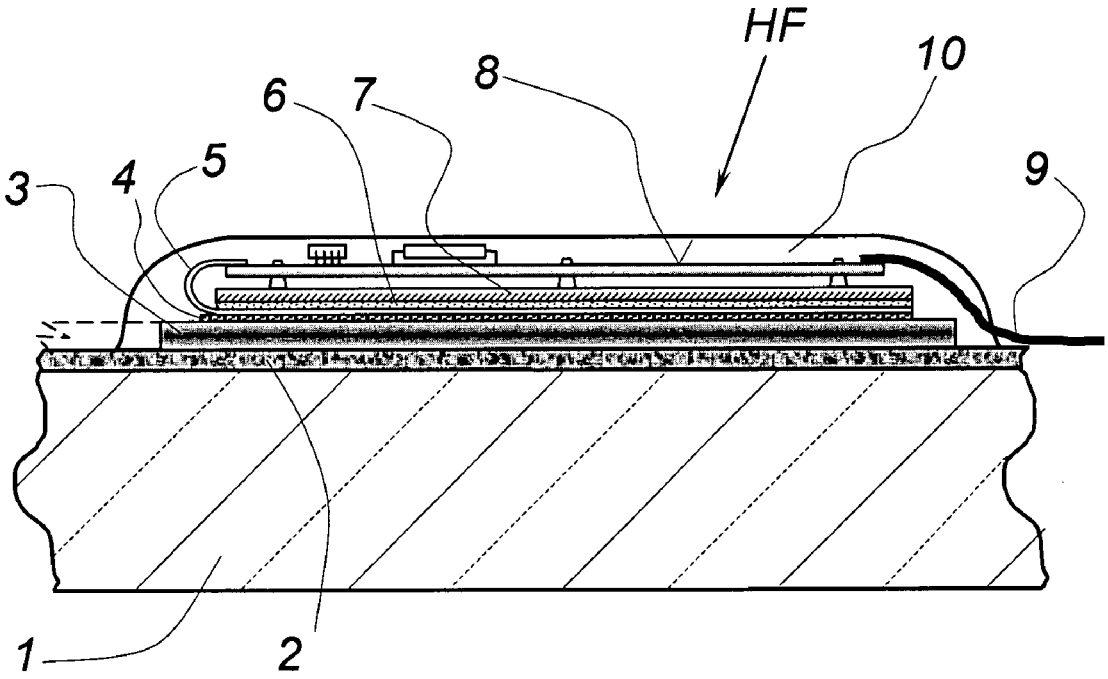
FIG. 1 shows, in a simplified representation (without any particular scale), a section through the edge region of an antenna window, to which a high-frequency component is permanently fastened by means double-sided adhesive tape.
Figure 2:
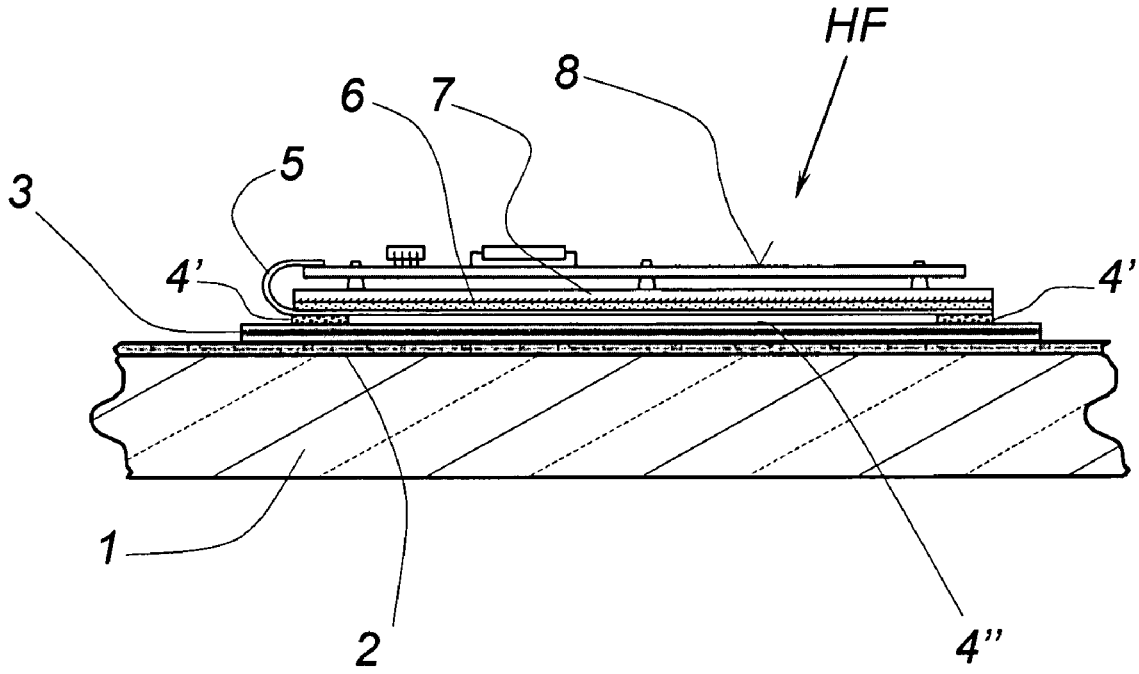
FIG. 2 shows the antenna window with a layer of air.

A thin flat electrode 5 made of a metal which is a good conductor, for example made of copper, is assembled directly to the adhesive tape 4. Alternatively, the adhesive tape 4 is replaced by air gap 4" and spacers 4' are provided to maintain the air gap 4" as shown in FIG. 2.

The adhesive tape 4 forms a dielectric separation layer with a specific thickness between the conducting structure 3 and the flat electrode 5. Its thickness determines the separation of the two electrodes, which should not exceed about 0.5 mm, and thus plays a determining part in the capacitive transmission behavior of the device.

There should be no galvanic contact between the conducting structure 3 and the high-frequency component HF. On the contrary, the conducting structure 3 acts as a first electrode for capacitive coupling of signals in the high-frequency component HF by means of the flat electrode 5. In the case of the example, the latter has a length of about 100 mm, a width of 10 mm and a thickness of 35 μm. At this location, the conducting structure has a width of more than 10 mm and a thickness of 4–15 μm with a silver content of >70% and a specific resistance of $2.85–5.45\times10^{-6}$ [Ωcm]. Thus satisfactory transmission behavior has been achieved in the frequency region >40 MHz, therefore VHF, FM, UHF, etc. signals are transmitted reliably and with high quality.

The geometrical dimensions of the components of the equipment may be kept constant within narrow tolerance ranges. It is important that the adhesive layer does not allow moisture to penetrate. Preferably, an acrylate adhesive is employed in the form of a film or foam, whose permittivity is between 2 and 4.

Thus, overall, a capacitor suitable for transmitting high-frequency signals is formed from the conducting structure 3 to the flat electrode 5 or subsequent components of the high-frequency component HF.

The flat electrode 5 is connected from the other side to a relatively thick elastic layer 6, again preferably adhesively bonded, which may and must compensate for slight curvature in the surface of the window 1. The flat electrode 5 itself is sufficiently thin to be able to follow any curvature of the large surface in practice. Consequently, these curvatures have only a negligible effect on the width of the slot or on the thickness of the adhesive tape 4. Next comes a support plate 7, which forms the mechanical rear reinforcement of the high-frequency component HF. Depending on the mounting environment of the assembly, this support plate may be rigid or flexible. A mounting plate 8, with electronic equipment which there is no need to explain further, is fastened thereto. The mounting plate may also, like the support plate, be rigid or flexible depending on the imposed requirements, if the environment of the assembly so requires (for example very small radii of curvature of the surface of the window at the location of assembly) or if the high-frequency component has relatively large surface dimensions.

Figure 3:
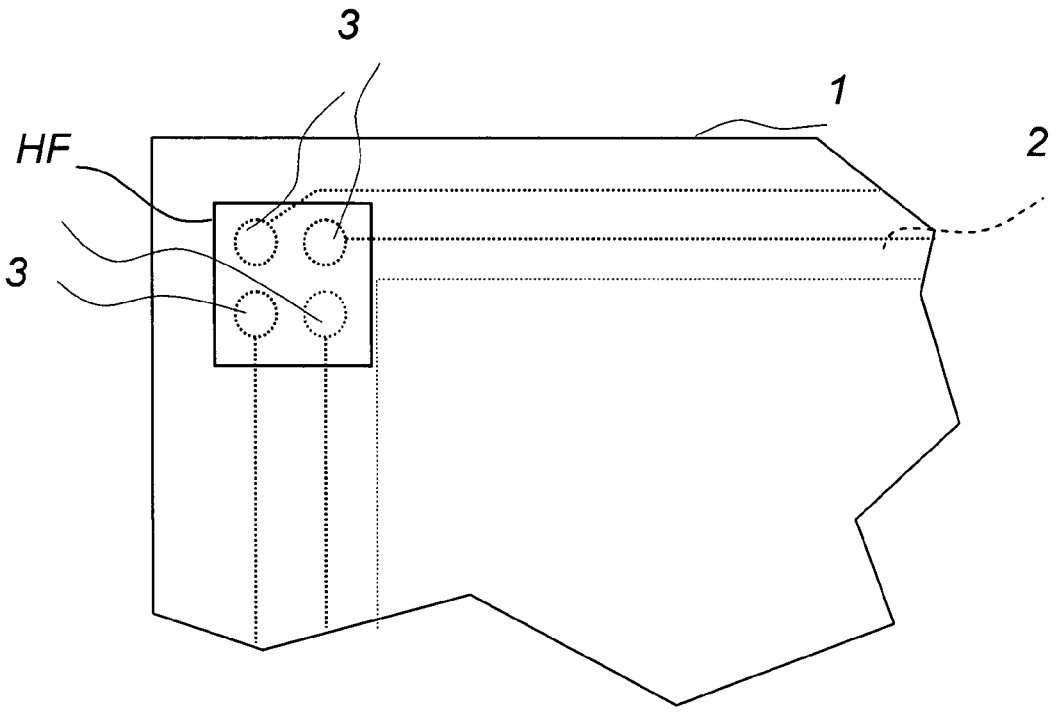
FIG. 3 shows a plane view of the antenna window with plural flat parts.

The conducting structure 3 is divided into plural parts conducting signals as shown in FIG. 3, which plural parts are distant and electrically separated from each other, with which the specific coupling electrode of the high-frequency component is individually spatially and functionally combined. FIG. 3 also shows inner edges of the opaque coating 2.

Figure 4:
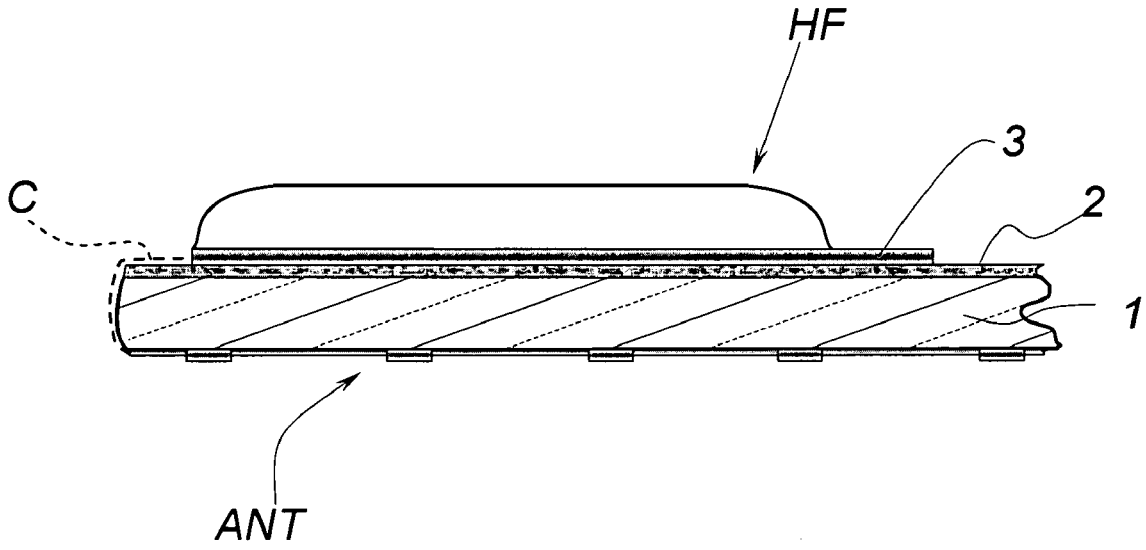
FIG. 4 shows a cross section of the antenna according to another embodiment of the present invention.
Figure 5:
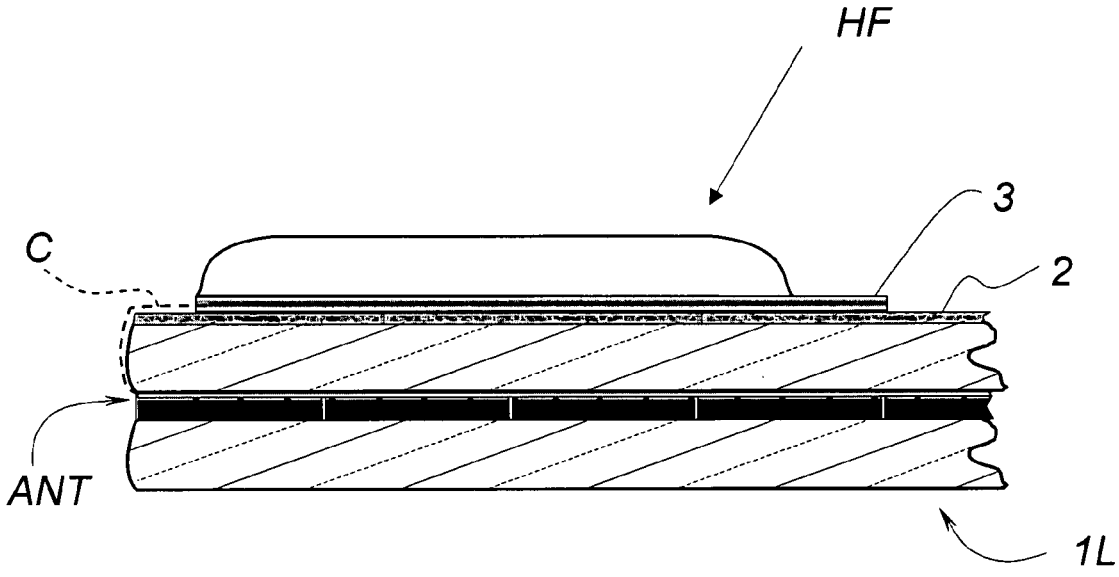
FIG. 5 shows a cross section of the antenna formed on a laminated glass pane.

FIG. 4 shows an embodiment in which layer 3 is electrically connecting through connection C to another side of the glass window 1, where the HF structure is not formed. On the other side of the window 1, screen printed antenna elements ANT are formed. Alternately, if the connector C is not provided, the elements 3 and ANT can be capacitively coupled. Further, the window 1 can have a laminated structure 1L as shown in FIG. 5. Thus, the another surface of the antenna window 1 is an inside of the laminated window 1L.

Finally, a signal cable 9 is electrically connected to the mounting plate, or to the conducting tracks formed thereon. Signals are transmitted by this (shielded) signal cable 9 apparatuses placed downstream, not shown here (radio or TV receivers, telephone exchanges, etc.); furthermore, it serves to supply the high-frequency component HF with electric current and possibly to connect it to ground.

This entire device is encapsulated with an overmolding compound 10, which firmly bonds to the surface of the antenna window 1, or to the opaque coating 2 and hermetically protects the high-frequency component HF against moisture and dirt.

The invention claimed is:

1. An antenna window comprising:

a flat conductor structure having first and second main surfaces, the first main surface being configured to be attached to a window and being opposite to the second main surface; and a high-frequency electric component placed fixedly on the second main surface of the flat conductor structure, the high-frequency electric component being electrically connected by an electrical connection to the flat conductor structure, wherein the high-frequency electric component has at least one flat coupling electrode, which is kept at a specific distance from the flat conductor structure conducting high-frequency antenna signals, by an intermediate dielectric layer, to form the electrical connection, and the flat conductor structure, the intermediate dielectric layer, and the at least one flat coupling electrode act as a capacitor.

2. The antenna window as claimed in claim 1, wherein the high-frequency component comprises a support plate supporting the flat coupling electrode together with other components connected thereto.

3. The antenna window as claimed in claim 1, wherein the intermediate dielectric layer is formed by adhesive tape of a specific thickness.

4. The antenna window as claimed in claim 1, wherein the intermediate dielectric layer is a layer of air with a specific thickness.

5. The antenna window as claimed in claim 1, wherein the high-frequency component is fastened to the antenna window and is overmolded, hermetically against air and water vapor, by a cured compound bonding to the same surface of the antenna window.

6. The antenna window as claimed in claim 1, wherein the flat conductor structure includes an electrically conducting paste to be baked, which is printed and baked on one surface of the antenna window.

7. The antenna window as claimed in claim 1, wherein antenna elements include an electrically conducting paste to be baked, which is printed and baked.

8. The antenna window as claimed in claim 1, wherein the flat conductor structure is connected, electrically or capacitively, to antenna elements that are placed on another surface of the antenna window.

9. The antenna window as claimed in claim 8, wherein the another surface of the antenna window is an inside of a laminated window.

10. The antenna window as claimed in claim 1, wherein the flat conductor structure is divided into plural parts conducting signals, which plural parts are distant and electrically separated from each other, with which the flat coupling electrode of the high-frequency component is individually spatially and functionally combined.

* * * * *